United States Patent [19]

Linhart et al.

[11] Patent Number: 4,772,359

[45] Date of Patent: Sep. 20, 1988

[54] PRODUCTION OF PAPER, BOARD AND CARDBOARD

[75] Inventors: Friedrich Linhart, Heidelberg; Hans-Juergen Degen, Lorsch; Werner Auhorn, Frankenthal; Michael Kroener, Mannheim; Heinrich Hartmann, Limburgerhof; Wilfried Heide, Freinsheim, all of Fed. Rep. of Germany

[73] Assignee: BASF Aktiengesellschaft, Rheinland-Pfalz, Fed. Rep. of Germany

[21] Appl. No.: 55,354

[22] Filed: May 29, 1987

[30] Foreign Application Priority Data

Jun. 14, 1986 [DE] Fed. Rep. of Germany ..... 3620065

[51] Int. Cl.[4] ..... D21H 3/02

[52] U.S. Cl. ..... 162/163; 162/165; 162/168.2; 162/168.4; 162/168.5; 162/180

[58] Field of Search ..... 162/168.2, 168.4, 168.5, 162/165, 166, 163, 180

[56] References Cited

U.S. PATENT DOCUMENTS

| | | | |
|---|---|---|---|
| 3,036,950 | 5/1962 | Martin | 162/168.5 |
| 3,081,219 | 4/1963 | Drennen | 162/72 |
| 3,597,314 | 8/1971 | Laube et al. | 162/168.3 |
| 3,926,718 | 12/1975 | Guilbault et al. | 162/168.2 |
| 4,057,533 | 11/1977 | Hort et al. | 162/168.2 |
| 4,144,123 | 3/1979 | Scharf et al. | 162/164.6 |
| 4,167,439 | 9/1979 | Killam | 162/163 |
| 4,305,781 | 12/1981 | Langley et al. | 162/164.6 |
| 4,421,602 | 12/1983 | Brunnmueller et al. | 162/168.2 |
| 4,444,662 | 4/1984 | Burkert et al. | 210/735 |
| 4,444,667 | 8/1984 | Burkert et al. | 210/735 |
| 4,644,020 | 2/1987 | Stahl | 210/735 |

FOREIGN PATENT DOCUMENTS

| | | | |
|---|---|---|---|
| 848936 | 9/1960 | United Kingdom | 162/168.5 |
| 937935 | 9/1963 | United Kingdom . | |
| 994499 | 6/1965 | United Kingdom | 162/168.5 |
| 1141166 | 3/1966 | United Kingdom . | |

OTHER PUBLICATIONS

Tappi Journal (1984), vol. 67, #9, Atlanta, GA "Filler and Fiber Retention . . . ".

*Primary Examiner*—Peter Chin
*Attorney, Agent, or Firm*—Oblon, Fisher, Spivak, McClelland & Maier

[57] ABSTRACT

Paper, board and cardboard are produced by draining a pulp slurry in the presence of high molecular weight, water-soluble polymers of N-vinylamides as drainage aids, retention agents and flocculants. These polymers are particularly effective in a pulp slurry which has a high content of interfering substances and other phenolic compounds.

16 Claims, No Drawings

PRODUCTION OF PAPER, BOARD AND CARDBOARD

U.S. Pat. No. 4,144,123 discloses that crosslinked polyamidoamines grafted with ethyleneimine can be used as drainage aids and retention agents in papermaking. Suitable crosslinking agents are $\alpha,\omega$-dichlorohydrin ethers of polyalkylene oxides containing from 8 to 100 alkylene oxide units. Crosslinking is carried out in such a way that the resulting products are still water-soluble.

U.S. Pat. No. 4,421,602 discloses the use of another class of polymers possessing cationic groups as retention agents, drainage aids and flocculants in papermaking. These polymers are obtained by first polymerizing N-vinylformamide and then partially hydrolyzing the resulting poly-N-vinylformamide so that it contains not only N-formylamino groups but also free amino groups. If the aminoethyl-containing condensates described above or the hydrolyzed poly-N-vinylformamides are used as drainage aids and retention agents in papermaking, these products, because of their positive charge, are adsorbed by the negatively charged surfaces of the solid particles in the pulp slurry and thus facilitate binding of the originally negatively charged particles to one another. Consequently, a higher drainage rate and greater retention are observed.

In practice, anionic polyacrylamides are used to a certain extent as retention agents and drainage aids in papermaking. However, it is necessary also to use a cationic additive which fixes the nonionic polymer on the negatively charged surfaces of the particles. Suitable cationic additives for use for this purpose in practice are, for example, aluminum salts or cationic starches.

In practice, nonionic water-soluble polymers, such as high molecular weight polyacrylamides, are used in papermaking not alone but exclusively in combination with other additives (cf. European Pat. No. 17,353). Such nonionic products can be adsorbed onto the negatively charged particles of the pulp slurry only via comparatively weak hydrogen bonds. The nonionic products are therefore not very effective, but their effectiveness is certainly not reduced, by anionic compounds dissolved or dispersed in colloidal form in the pulp slurry, to the extent that this takes place where cationic polymers are used. Because the water circulations in the paper mills have been more and more restricted over the past few years, the anionic compounds present in the pulp slurry accumulate in the recycled water and have an adverse effect on the efficiency of cationic polymeric aids in the drainage of the pulp slurry and on the retention.

It is an object of the present invention to provide a drainage aid, retention agent and flocculant for the papermaking process which is more efficient than known nonionic aids, and whose efficiency is not adversely affected by interfering anionic substances.

We have found that this object is achieved, according to the invention, by a process for the production of paper, board and cardboard by draining a pulp slurry in the presence of drainage aids, retention agents and flocculants with sheet formation, if the drainage aids, retention agents and flocculants used are high molecular weight, water-soluble polymers of N-vinylamides.

In the novel process, the pulp slurry drained is one which can be prepared using any fiber grades, either alone or as a mixture with one another. The pulp slurry is prepared in practice using water, some or all of which is recycled from the paper machine. This is either clarified or unclarified white water or mixtures of such waters. The recycled water contains larger or smaller amounts of interfering substances which are known to have a very adverse effect on the efficiency of the cationic drainage aids and retention agents. The content of such interfering substances in the pulp slurry is usually characterized by the overall parameter of chemical oxygen demand (COD). This overall parameter also includes phenolic compounds which per se do not necessarily have an adverse effect but, as degradation products of lignin, are always present together with interfering substances. The COD values are from 300 to 30,000, preferably from 1,000 to 20,000, mg of oxygen per kg of the aqueous phase of the pulp slurry.

All grades of pulps are suitable, for example mechanical pulp, bleached and unbleached chemical pulp and pulp slurries of all annual plants. Mechanical pulp includes, for example, groundwood, thermomechanical pulp (TMP), chemothermomechanical pulp (CTMP), pressure pulp, semichemical pulp, high-yield chemical pulp and refiner mechanical pulp (RMP). Examples of suitable chemical pulps are sulfate, sulfite and soda pulps. The unbleached pulps, which are also referred to as unbleached kraft pulp, are preferably used.

Suitable annual plants for the production of pulp slurries are, for example, rice, wheat, sugarcane and kenaf.

We have found, surprisingly, that a pulp slurry containing interfering substances can advantageously be drained using high molecular weight, water-soluble polymers of N-vinylamides, and greater retention and flocculation of fibers and fillers can be achieved. Suitable polymers of open-chain amides are obtained by homopolymerization or copolymerization of compounds of the formula $$CH_2-CH(R^1)-N-CO-R^2, \quad (I)$$

where $R^1$ and $R^2$ are each H, $CH_3$ or $C_2H_5$. Examples of suitable substances are the homopolymers or copolymers of N-vinylformamide, N-vinylacetamide, N-methyl-N-vinylformamide, N-methyl-N-vinylacetamide, N-ethyl-N-vinylformamide, N-ethyl-N-vinylacetamide and N-vinylpropionamide. Examples of suitable comonomers are acrylamide, methacrylamide, acrylonitrile, methacrylonitrile, acrylates of monohydric $C_1$–$C_{18}$-alcohols, methacrylates of monohydric $C_1$–$C_{18}$-alcohols, vinyl acetate, vinyl propionate, vinyl butyrate, vinyl methyl ether, vinyl ethyl ether, vinyl n-butyl ether and vinyl isobutyl ether. The copolymers of the compounds of the formula I contain not less than 50, preferably from 80 to 99, % by weight of a compound of the formula I as copolymerized units. The homopolymers and copolymers are present in the unhydrolyzed form and therefore do not contain any amino groups. They have a K value of not less than 130 (measured according to H. Fikentscher in 5% strength by weight sodium chloride solution at 25° C. and a polymer concentration of 0.1% by weight). The K value of the homopolymers and copolymers is preferably from 160 to 250.

Other suitable drainage aids, retention agents and flocculants are polymers of cyclic N-vinylamides of the formula

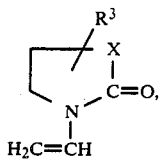

(II)

where X is $—CH_2—$, $—CH_2—CH_2—$, $CH_2—CH_2—CH_2—$, —O— and $—O—CH_2—$ and $R^3$ is H, $C_1$–$C_3$-alkyl or phenyl. The compounds of the formula II are homopolymers or copolymers of N-vinylpyrrolidone, N-vinylpiperidone, N-vinylcaprolactam, N-vinyl-3-methylpyrrolidone, N-vinyl-5-methylpyrrolidone, N-vinyl-5-phenylpyrrolidone, N-vinyl-3-benzylpyrrolidone, N-vinyl-4-methylpiperidone, N-vinyl-2-oxazolidone, N-vinyl-5-methyl-2-oxazolidone, N-vinyl-5-ethyl-2-oxazolidone, N-vinyl-5-phenyl-2-oxazolidone, N-vinyl-4-methyl-2-oxazolidone, N-vinyl-3-oxazolid-2-one and N-vinylmorpholinone. The polymers have a K value of not less than 130 (measured according to H. Fikentscher in 5% strength sodium chloride solution at 25° C. and at a polymer concentration of 0.1% by weight). The K value of these polymers is preferably from 160 to 250. Suitable comonomers for the preparation of the copolymers are, for example, acrylamide, methacrylamide, acrylonitrile, methacrylonitrile, acrylates of monohydric $C_1$–$C_{18}$-alcohols and the corresponding methacrylates.

It is also possible to prepare copolymers which contain two or more comonomers as copolymerized units. The copolymers contain not less than 50, preferably from 80 to 99, % by weight of compounds of the formula II as copolymerized units. Of particular importance are copolymers of compounds of the formula I with those of the formula II. These comonomers may be copolymerized with one another in any ratio and used in the novel process. Particularly noteworthy are the copolymers of N-vinyl-formamide and N-vinylpyrrolidone and copolymers of N-vinylformamide and N-vinylcaprolactam.

The homopolymers and copolymers which are effective drainage aids, retention agents and flocculants are used in an amount of from 0.002 to 0.1, preferably from 0.005 to 0.05, % by weight, based on dry pulp. The polymers are added in very dilute solution to the pulp slurry, as is usual where other high molecular weight water-soluble polymers are used. The concentration in the aqueous solution is in general from 0.001 to 0.1% by weight.

The high molecular weight compounds containing copolymerized N-vinylamides disply their efficiency as drainage aids, retention agents and flocculants in the presence of interfering substances which contain, as accompanying substances, oligomers and/or polymers containing phenolic groups and derived from the ingredients of the wood, these interfering substances always being present in restricted or closed water circulations during papermaking. If the pulp slurry to be drained does not contain any oligomers or polymers containing phenolic groups, such compounds can be added to the pulp slurry before drainage without adversely affecting the efficiency of the polymers to be used according to the invention. On the contrary, polymers of N-vinylamides and oligomers or polymers containing phenolic groups have a synergistic effect during drainage, retention and flocculation. The compounds containing phenolic groups are either synthetic phenol resins or natural oligomers and/or polymers containing phenol groups. It is also possible to use mixtures of natural and synthetic products. Examples of synthetic products are phenol resins obtainable by condensation of phenol and aldehydes, such as formaldehyde, acetaldehyde, propionaldehyde, n-butyraldehyde or isobutyraldehyde. Particularly suitable phenol resins are those formed by condensation of phenol and formaldehyde. The resins of the resol type as well as those of the novolak type are suitable. Resins of the resol type are known to be phenol/formaldehyde resins formed by condensation of phenol with formaldehyde in an alkaline medium. Noncurable phenol resins and resins of the novolak type are prepared by condensation of phenol with formaldehyde in the presence of acids. The resins of the resol and novolak types are preferably used in the form of aqueous alkaline solutions of pH 9–14. Phenol resins of the novolak or resol type are described in, for example, Ullmanns Encyklopädie der Technischen Chemie, 4th edition, Verlag Chemie, Weinheim 1979, volume 18, pages 245–257. Suitable phenol resins are preferably water-soluble or dispersable in water. The phenol resins are added in an amount of from 0.02 to 1, preferably from 0.05 to 0.4, % by weight, based on dry pulp.

Natural oligomers and polymers containing phenol groups are the known wood extracts, lignin degradation products from production of sulfate pulp, ie. kraft lignin, and humic acids and their salts. The wood extracts contain lignin degradation products, ie. phenolic oligomers. The exact composition of the natural products is not known and depends to a great extent on the working conditions during isolation of the extracts. Although these natural oligomers or polymers containing phenolic groups, ie. lignin degradation products, humic acids and wood extracts, frequently have a very adverse effect on the efficiency of the conventional cationic retention agents, owing to the nonphenolic substances which accompany the said oligomers and polymers, they unexpectedly increase the efficiency of the poly-N-vinylamides to be used according to the invention as drainage aids, retention agents and flocculants in papermaking. It is not critical whether the phenolic compounds are added separately to the pulp slurry or the pulp slurry to be drained already contains the phenolic compounds from the production of the pulp or the recycling of white water from the papermaking process. Because of their lignin content, all pulps and in particular the unbleached pulps possess phenolic groups on their surface, the number of such groups being higher the lower the degree of bleaching. The presence of phenolic compounds in the pulp slurry promotes in particular the drainage-accelerating properties of the poly-N-vinylamides. Compared with the known processes for the production of paper, board and cardboard, the substantial advantage of the novel process is the insensitivity to the presence of interfering substances. Moreover, in the making of wood-free white papers, the drainage aids and retention agents have scarcely any adverse effect on the whiteness of the paper in comparison with the corresponding cationic products.

In the Examples, parts and percentages are by weight.

Determination of the drainage time: 1 l of each of the pulp slurries to be tested is drained in a Schopper-Riegler test apparatus. The times determined for various discharge volumes are used are the criterion for the drainage rate of the particular pulp slurry investigated.

The drainage times were determined after 500 and 600 ml of water had flowed through.

Optical transparency of the white water: this was determined with the aid of a photometer and is a measure of the retention of fines and fillers. It is stated as a percentage. The higher the value of the optical transparency, the better is the retention.

The charge density was determined according to D. Horn, Polyethyleneimines-Physiocochemical Properties and Application, (IUPAC) Polymeric Amines and Ammonium Salts, Pergamon Press Oxford and New York, 1980, pages 333–355.

The K value of the polymers was determined according to H. Fikentscher, Zellulose-Chemie 13, (1932) 48–64 and 71–74, in 5% strength aqueous sodium chloride solution at 25° C. and at a polymer concentration of 0.1% by weight; $K=k\cdot 10^3$.

The following starting materials were used: The polymers I to V served for comparison with the prior art.

Polymer I:

Commercial cationic copolymer of 60% of acrylamide and 40% of diethylaminoethyl acrylate sulfate, K value of the copolymer 220.

Polymer II:

Homopolymer of acrylamide, having a K value of 210.

Polymer III:

Commercial cationic polyamidoamine having a charge density of 7 milliequivalents per g and a viscosity of 500 mPa.s in 40% strength aqueous solution at 20° C.

Polymer IV:

Polyamidoamine of adipic acid and diethylenetriamine, grafted with ethyleneimine and crosslinked with $\alpha,\omega$-dichloropolyethylene glycol ether containing 9 ethylene oxide units (cationic drainage aid and retention agent according to U.S. Pat. No. 4,144,123, Example 3).

Polymer V:

Partially hydrolyzed poly-N-vinylformamide, prepared according to U.S. Pat. No. 4,421,602 by heating poly-N-vinylformamide with hydrochloric acid so that 40% of the formyl groups are eliminated; K value of the copolymer 175.

Polymers VI–XIV to be used according to the invention:

Polymer VI:

Poly-N-vinylformamide, K value 175

Polymer VII:

Poly-N-vinylformamide, K value 190

Polymer VIII:

Poly-N-vinylformamide, K value 227

Polymer IX:

Poly-N-vinylpyrrolidone, K value 140

Polymer X:

Poly-N-vinylpyrrolidone, K value 152

Polymer XI:

Poly-N-vinylpyrrolidone, K value 165

Polymer XII:

Poly-N-vinylpyrrolidone, K value 179

Polymer XIII:

Poly-N-methyl-N-vinylformamide, K value 197

Polymer XIV:

Copolymer of N-vinylformamide and N-vinylpyrrolidone in a weight ratio of 1:1, K value of the copolymer 185.

Phenol derivatives

Phenol I:

Commercial resol of 1 mole of phenol and 2.6 moles of formaldehyde, viscosity 160 mPa.s in 48% strength aqueous solution at an alkali content of 8.5%, pH 12.6.

Phenol II:

Commercial novolak having a softening temperature of 109°–111° C. in 46% strength aqueous solution, pH 12.

Phenol III:

Commercial humic acid in the form of the sodium salt, pH 9.0.

Phenol IV:

Commercial lignin obtained from the kraft pulp process, dissolved in dilute sodium hydroxide solution.

EXAMPLE 1

A pulp having a pulp slurry consistency of 2 g/l is prepared from unprinted newsprint of Central European origin, and 0.2 g/l of kaolin is also added to the pulp slurry. The pulp slurry has a pH of 7.3. First, the drainage rate is determined for the pulp slurry thus prepared (cf. (a) in Table 1). Then, 0.1%, based on dry pulp, of phenol I is added (b) to part of the pulp slurry, and the drainage rate and the optical transparency of the white water are determined again. 0.02% of polymer VII is added to another sample of the pulp slurry prepared in this manner (c), and the drainage effect and the optical transparency of the white water are assessed. Another sample of pulp slurry (d) is first mixed with 0.1% of phenol I and then with 0.02% of polymer VII, and the drainage rate is tested in the Schopper-Riegler apparatus. The added amounts indicated are based in each case on dry pulp. The following results are obtained:

TABLE 1

| | Drainage (sec./500 ml) | Optical transparency of the white water (%) |
|---|---|---|
| (a) no additive | 110 | 31 |
| (b) 0.1% of phenol I | 117 | 28 |
| (c) 0.02% of polymer VII | 106 | 41 |
| (d) 1. 0.1% of phenol I<br>2. 0.02% of polymer VII | 61 | 63 |

The results show clearly that neither the phenol I nor the polymer VII alone accelerates drainage, whereas in combination according to (d) they dramatically increase the drainage rate and the optical transparency of the white water.

EXAMPLE 2

This example is carried out using a pulp slurry which consists of 75 parts of groundwood, 25 parts of bleached sulfate pulp and 20 parts of kaolin and to which 0.5% of aluminum sulfate has been added. The consistency of the slurry is brought to 6 g/l, and the pH is 6. The following tests are carried out:

(a) Determination of the drainage rate and the optical transparency of the white water of the pulp slurry described above and containing no further additives, (b) Of the pulp slurry (a) to which 0.1% of phenol I has been added, (c) Of the pulp slurry (a) to which 0.02% of polymer VII has been added and (d) To the pulp slurry (a) to which 0.1% of phenol I has been added, followed by 0.02% of polymer VII. The results for the drainage and optical transparency of the white water are shown in Table 2, the amount of additives being based in each case on dry fiber, as in the Examples below.

TABLE 2

| | Drainage (sec./500 ml) | Optical transparency of the white water (%) |
|---|---|---|
| (a) no additive | 164 | 35 |
| (b) 0.1% of phenol I | 153 | 35 |
| (c) 0.02% of polymer VII | 141 | 49 |
| (d) 1. 0.1% of phenol I<br>2. 0.02% of polymer VII | 96 | 63 |

The synergistic effect of phenol I and polymer VII on the drainage rate and the retention in test (d) is clearly evident.

EXAMPLE 3

A pulp slurry is prepared from 80 parts of bleached sulfite pulp and 20 parts of kaolin, and the consistency of the slurry is brought to 2 g/l. The pH of the slurry is 7.5 and the COD is 440 mg of $O_2$/kg. To determine the retention effect, sheets are formed using a Rapid-Köthen apparatus, and their basis weight and filler content are determined. The higher these two values, the better is the retention. As shown in Table 3, 2 test series are carried out, in which (a) 0–0.4%, based on dry fiber, of polymer VII is added to the above pulp slurry and (b) first 0.1% of phenol I and then the amounts of polymer VII stated in the table are added to the pulp slurry.

TABLE 3

| Polymer | Basis weight (g/m²) | | | | Filler content (%) | | | |
|---|---|---|---|---|---|---|---|---|
| VII (%) | 0 | 0.01 | 0.02 | 0.04 | 0 | 0.01 | 0.02 | 0.04 |
| Phenol I(%) | | | | | | | | |

TABLE 3-continued

| Polymer | Basis weight (g/m²) | | | | Filler content (%) | | | |
|---|---|---|---|---|---|---|---|---|
| VII (%) | 0 | 0.01 | 0.02 | 0.04 | 0 | 0.01 | 0.02 | 0.04 |
| (a) 0 | 60.6 | 64.4 | 64.2 | 64.3 | 3.4 | 6.2 | 8.6 | 9.7 |
| (b) 0.1 | 60.9 | 64.4 | 65.5 | 67.4 | 2.6 | 9.1 | 11.7 | 13.7 |

EXAMPLE 4

A pulp slurry in deionized water, having a consistency of 2 g/l, is first prepared from groundwood, using 200 ml of spruce extract per liter of pulp slurry. The slurry has a pH of 5. The spruce extract is obtained by boiling 3 kg of spruce chips in 30 l of deionized water for 2 hours and has a COD value of 3,400 mg of $O_2$/kg. The tests stated in Table 4 are then carried out, (a) a first drainage being effected in the absence of additional phenol-containing compounds and then (b) the drainage and transparency of the white water being determined after the addition of 0.1% of phenol II to the pulp slurry.

TABLE 4

| | (a) Absence of additional phenol-containing compounds | | (b) After the addition of 0.1% of phenol II before the addition of the polymer to the pump slurry | |
|---|---|---|---|---|
| | Drainage time (sec./500 ml) | Optical transparency of the white water (%) | Drainage time (sec./500 ml) | Optical transparency of the white water (%) |
| No additive | 108 | 48 | 106 | 44 |
| Polymer I (0.02%) (comparison) | 89 | 53 | 88 | 57 |
| Polymer VII (0.02%)(1) | 82 | 53 | 64 | 60 |
| Polymer VIII (0.02%)(1) | 69 | 61 | 48 | 71 |

(1)Example according to the invention.

As is evident from Table 4, poly-N-vinylformamide in the presence of large amounts of spruce extract is a more efficient drainage aid than a very efficient, commercial cationic polyacrylamide. The efficiency of poly-N-vinylformamide develops in particular after the addition of phenol resin to the pulp slurry.

EXAMPLE 5

The pulp slurry described in Example 4 and containing spruce extract is tested according to versions (a) to (d). The results are summarized in Table 5. As shown in this table, poly-N-vinylformamide has a better drainage and retention action than the high molecular weight nonionic polyacrylamide, particularly after the addition of phenol I.

TABLE 5

| | Drainage time (sec./600 ml) | Optical transparency of the white water (%) | Drainage time (sec./600 ml) after addition of 0.1% of phenol I | Optical transparency (%) |
|---|---|---|---|---|
| (a) No additive | 148 | 29 | 139 | 35 |
| (b) (0.01%) of polymer II | 156 | 31 | 138 | 31 |
| (0.02%) of | 156 | 30 | 135 | 33 |
| (c) (0.01%) of polymer VII(1) | 99 | 46 | 65 | 60 |
| (0.02%) of polymer VII(1) | 96 | 52 | 57 | 67 |
| (d) (0.01%) of polymer VIII(1) | 79 | 61 | 55 | 71 |
| (0.02%) of | 69 | 70 | 41 | 80 |

TABLE 5-continued

| | Drainage time (sec./600 ml) | Optical transparency of the white water (%) | Drainage time (sec./600 ml) after addition of 0.1% of phenol I | Optical transparency (%) |
|---|---|---|---|---|
| polymer VIII[1] | | | | |

[1]Example according to the invention.

EXAMPLE 6

The pulp slurry stated in Example 4 is used and the investigations (a) to (g) stated in Table 6 are carried out.

TABLE 6

| Additive | | Drainage time (sec./500 ml) | Optical transparency of the white water (%) |
|---|---|---|---|
| 1. Phenol derivative (%) | 2. Polymer (%) | | |
| (a) — | — | 106 | 28 |
| (b) — | III (0.04) comparison | 102 | 28 |
| (c) — | V (0.04) comparison | 103 | 28 |
| (d) — | VI (0.04) comparison | 105 | 28 |
| (e) 0.4 phenol I | III (0.4) comparison | 110 | 21 |
| (f) 0.4 phenol I | V (0.04) comparison | 109 | 28 |
| (g) 0.4 phenol I | VI (0.04) | 86 | 34 |

Test (g) is an example according to the invention and shows that poly-N-vinylformamide is an efficient drainage aid and retention agent after the addition of a phenolic compound.

EXAMPLE 7

A pulp slurry is first prepared from 75 parts of groundwood, 25 of bleached sulfate pulp, 20 parts of kaolin and 0.5% of aluminum sulfate, and the consistency of the slurry is brought to 2 g/l. The pH of the slurry is 6. The drainage time and optical transparency of the white water for this pulp slurry and the polymers stated in the table under (b) to (d) are first investigated, after which another test series is carried out in which first 0.1% of phenol I is added to the pulp slurry described above and then the amounts of polymer stated in the table under (b) to (d) are introduced.

TABLE 7

| % addition | I Drainage time (sec./600 ml) | Optical transparency of the white water (%) | II Drainage time (sec./600 ml) after the addition of 0.1% of phenol I followed by addition of the polymer | Optical transparency of the white water (%) |
|---|---|---|---|---|
| (a) No additive | 123 | 27 | 110 | 28 |
| (b) 0.2% of polymer VII | 106 | 41 | 82 | 49 |
| (c) 0.2% of polymer XIII | 103 | 42 | 84 | 51 |
| (d) 0.2% of polymer XIV | 104 | 36 | 79 | 51 |

II (b) to II (d) are examples according to the invention.

The table shows that various poly-N-vinylamides in the presence of phenol derivatives have similar synergistic effects in drainage and retention.

EXAMPLE 8

A pulp slurry of unprinted newsprint of Central European origin, having a pH of 6, containing 0.5% of aluminum sulfate and having a consistency of 2 g/l, is drained under the conditions (a) to (d) stated in Table 8.

TABLE 8

| % addition | Drainage time (sec./600 ml) | Optical transparency of the white water (%) |
|---|---|---|
| (a) No additive | 76 | 42 |
| (b) 0.02% of polymer VIII | 75 | 61 |
| (c) 0.01% of phenol IV | 77 | 38 |
| (d) 1. 0.1% of phenol IV 2. 0.02% of polymer VIII | 53 | 75 |

Test (d) is an example according to the invention and shows that, together with poly-N-vinylformamide, even natural compounds containing phenol groups have a synergistic effect in drainage and retention during papermaking.

EXAMPLE 9

A pulp slurry of unprinted newsprint of Central European origin is used. The consistency of the slurry is brought to 2 g/l and its pH to 7.1. The tests shown in Table 9 are then carried out, the results being stated in Table 9.

TABLE 9

| | Drainage time (sec./500 ml) | | | Optical transparency of the white water (%) | | |
|---|---|---|---|---|---|---|
| Phenol derivative III (%) | 0 | 0.25 | 0.5 | 0 | 0.25 | 0.5 |
| (a) No additive | 97 | 94 | 101 | 37 | 40 | 37 |
| (b) 0.025% of polymer IV | 72 | 77 | 91 | 51 | 52 | 41 |
| (c) 0.02% of polymer VII (according to the invention) | 99 | 91 | 72 | 46 | 53 | 55 |

As shown in the table, the addition of humic acid (phenol III) reduces the efficiency of the cationic retention agent, whereas the efficiency of the poly-N-vinylformamide is surprisingly increased.

EXAMPLE 10

The investigations (a) to (c) shown in Table 10 are carried out for a slurry of unbleached sulfate pulp which has a freeness of 53 SR (Schopper-Riegler) and has been brought to a consistency of 2 g/l and a pH of 6 and to which 0.5% of aluminum sulfate has been added. The COD of the aqueous phase is 820 mg of $O_2$/kg.

TABLE 10

| Amount added (%): | Drainage (sec./600 ml) 0 | 0.01 | 0.02 | 0.04 | Optical transparency of the white water (%) 0 | 0.01 | 0.02 | 0.04 |
|---|---|---|---|---|---|---|---|---|
| (a) Polymer II comparison | 99 | 98 | 93 | 92 | 80 | 81 | 83 | 84 |
| (b) Polymer VII | 99 | 53 | 48 | 45 | 80 | 89 | 94 | 95 |
| (c) Polymer IX | 99 | 66 | 65 | 64 | 80 | 88 | 88 | 95 |

This example shows that poly-N-vinylformamide (b) and poly-N-vinylpyrrolidone (c) have an unexpectedly good drainage action and retention compared with an acrylamide homopolymer (a).

EXAMPLE 11

The drainage time and optical transparency of the white water are tested for a pulp slurry which consists of 100% of semi-chemical pulp and is brought to a consistency of 2 g/l. The pH of the slurry is 8.2. This slurry model is a pulp which has a high content of interfering substances and whose aqueous phase has a COD of 1,100 mg of $O_2$/kg. A highly cationic polymer which is effective under other conditions has virtually no activity under these conditions (values of the test series (b) are comparative examples), whereas poly-N-vinylformamide according to test series (a) is an efficient drainage aid and retention agent under these conditions.

TABLE 11

| | Drainage time (sec./700 ml) | | | | Optical transparency of the white water (%) | | | |
|---|---|---|---|---|---|---|---|---|
| Amount added (%): | 0 | 0.01 | 0.02 | 0.04 | 0 | 0.01 | 0.02 | 0.04 |
| (a) Polymer VII | 35 | 34 | 31 | 23 | 50 | 59 | 69 | 76 |
| Amount added (%): | 0 | 0.025 | 0.05 | 0.1 | 0 | 0.025 | 0.05 | 0.1 |
| (b) Polymer IV | 35 | 34 | 33 | 33 | 50 | 52 | 54 | 58 |

EXAMPLE 12

A pulp slurry is prepared from groundwood, the consistency being 2 g/l and the pH 5. Because of the content of natural compounds containing phenol groups on the fiber surfaces, and poly-N-vinylamides are efficient drainage aids and retention agents in this slurry model. The efficiency of the polymers increases with increasing molecular weight.

TABLE 12

| Amount added (%): | Drainage time (sec./500 ml) 0 | 0.01 | 0.02 | 0.04 | Optical transparency of the white water (%) 0 | 0.01 | 0.02 | 0.04 |
|---|---|---|---|---|---|---|---|---|
| Polymer X | 90 | 64 | 57 | 51 | 30 | 40 | 48 | 56 |
| Polymer XI | 90 | 64 | 56 | 48 | 30 | 40 | 46 | 57 |
| Polymer XII | 90 | 57 | 49 | 43 | 30 | 47 | 54 | 59 |

EXAMPLE 13

The investigations are carried out for a pulp which consists of 100 parts of unprinted newsprint of Central European origin, 20 parts of kaolin, 0.5% of alum and 0.1% of phenol I. The consistency of the slurry is brought to 2 g/l and the pH to 6.0.

TABLE 13

| Amount added (%): | Drainage (sec./500 ml) 0 | 0.01 | 0.02 | 0.04 | Optical transparency of the white water 0 | 0.01 | 0.02 | 0.04 |
|---|---|---|---|---|---|---|---|---|
| (a) Polymer VII | 93 | 62 | 56 | 49 | 26 | 59 | 67 | 74 |
| (b) Polymer VIII | 93 | 52 | 43 | 36 | 26 | 75 | 78 | 84 |
| (c) Polymer X | 93 | 73 | 66 | 60 | 26 | 44 | 51 | 57 |
| (d) Polymer XI | 93 | 71 | 64 | 56 | 26 | 47 | 52 | 63 |
| (e) Polymer XII | 93 | 66 | 57 | 38 | 26 | 50 | 57 | 65 |

As the results show, the drainage and retention effect of the polymers increases with increasing molecular weight.

EXAMPLE 14

The investigations (a) to (e) are carried out for a pulp slurry which consists of 30 parts of bleached sulfate pulp, 70 parts of bleached beech sulfite pulp and 30 parts of kaolin. The consistency of the slurry is brought to 2 g/l, the pH of the pulp is 7.2, the freeness is 45 Schopper-Riegler and the COD of the aqueous phase is 420 mg of $O_2$/kg. The slurry is drained in each case in a Rapid-Köthen apparatus under the conditions stated in Table 14, sheets having a basis weight of 60 g/m$^2$ being obtained. The filler content of the paper sheets serves as a measure of the retention. The whiteness of the paper sheets is measured by means of an Elrepho apparatus. Investigations (c), (d) and (e) are examples according to the invention.

TABLE 14

| | Amount [%] | Filler content in (%) | Whiteness (reflectance) |
|---|---|---|---|
| (a) No additive | | 7.2 | 86.6 |
| (b) Polymer IV | 0.05 | 12.8 | 83.3 |
| (c) 1. Phenol derivative I | 0.1 | | |
| 2. Polymer VII | 0.01 | 11.1 | 85.1 |
| (d) 1. Phenol derivative I | 0.1 | 13.6 | 84.5 |
| 2. Polymer VII | 0.02 | | |
| (e) 1. Phenol derivative I | 0.1 | | |
| 2. Polymer VII | 0.04 | 15.3 | 84.2 |

These results show that the combination of poly-N-vinylformamide with a phenol resin as a retention agent in making wood-free paper gives better retention than a highly efficient commercial retention agent, even when a smaller amount of the polymer to be used according to the invention is added, and that paper sheets exhibiting a smaller loss of whiteness are obtained.

EXAMPLE 15

To demonstrate the flocculating and clarifying action of the polymers to be used according to the invention, a waste water which contains 1.25 g/l of a thoroughly beaten thermomechanical pulp (TMP) and has a pH of 6 is prepared as a model substance. In each of the test series (a) to (c), 1 l of this waste water is introduced into a 1 l measuring cylinder, and 0.02 or 0.04% of the particular polymer is added (the floc size is assessed (visually) and rated from 0 (=no flocs) to 5 (=very large flocs)); the time taken for the boundary between suspension and supernatant to migrate from 1,000 ml to 900 ml is measured in seconds, and the clarity of the supernatant in percent is determined. The following results are obtained:

TABLE 15

| Amount added: | Floc size 0 | 0.02 | 0.04 | Fall rate sec/100 ml 0 | 0.02 | 0.04 | Clarity % 0 | 0.02 | 0.04 |
|---|---|---|---|---|---|---|---|---|---|
| (a) Polymer II | 0 | 1 | 1 | 180 | 240 | 200 | 64 | 62 | 65 |
| (b) Polymer VIII | 0 | 4 | 4 | 180 | 70 | 60 | 64 | 86 | 91 |
| (c) Polymer XII | 0 | 1 | 2 | 180 | 170 | 170 | 64 | 73 | 79 |

The test series (b) and (c) are examples according to the invention.

EXAMPLE 16

As described in Example 15, the flocculating and clarifying action of the products stated under (a) to (d) in Table 16 is determined for a waste water prepared for this purpose, which is obtained by beating mixed waste paper to such an extent that only a slimy slurry containing few fibers remains. The pH of the synthetic waste water is brought to 6.

TABLE 16

| Amount added (%): | Flocculation 0 | 0.02 | 0.04 | Fall rate (sec./100 ml) 0 | 0.02 | 0.04 | Clarity (%) 0 | 0.02 | 0.04 |
|---|---|---|---|---|---|---|---|---|---|
| (a) Polymer II | 0 | 1 | 1 | 320 | 280 | 280 | 26 | 58 | 69 |
| (b) 1. Phenol derivative I (0.1%) 2. Polymer II | 0 | 1 | 2 | 310 | 280 | 370 | 20 | 77 | 86 |
| (c) Polymer VIII | 0 | 4 | 5 | 320 | 245 | 160 | 26 | 69 | 71 |
| (d) 1. Phenol derivative I (0.1%) 2. Polymer VIII | 0 | 4 | 4 | 310 | 230 | 270 | 20 | 83 | 92 |

As the investigations show, only poly-N-vinylformamide alone and poly-N-vinylformamide in combination with phenol resin are satisfactory flocculants. (Investigations (c) and (d) are examples according to the invention).

We claim:

1. In a papermaking process utilizing an aqueous pulp slurry, the improvement which increases the drainage rate and the retention of fines, fillers and pigments, which improvement comprises:

adding to the pulp slurry an effective amount of a high molecular weight water-soluble polymer of N-substituted vinylamides having a K value of at least 130 (measured according to H. Fikentscher in 5% strength by weight sodium chloride solution at 25° C. and a polymer concentration of 0.1% by weight) and from 0.02 to 1.0% by weight, based on dry pulp, of a synthetic phenol resin or phenol-containing natural oligomers and/or polymers.

2. A process as claimed in claim 1 wherein the polymer is of an open-chain amide of the formula $$CH_2{=}CH{-}\overset{\overset{\displaystyle R^1}{|}}{N}{-}CO{-}R^2 \qquad \text{(I)}$$

where $R^1$ and $R^2$ are each H, $CH_3$ or $C_2H_5$.

3. A process as claimed in claim 1 wherein the polymer is of a cyclic N-vinylamide of the formula

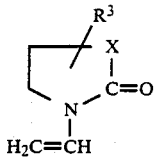

(II)

where X is $-CH_2-$, $-CH_2-CH_2-$, $-CH_2-CH_2-CH_2-$, $-O-$ or $-O-CH_2-$ and $R^3$ is H, $C_1$-$C_3$-alkyl or phenyl,.

4. A process as claimed in claim 1, wherein homopolymers or copolymers of N-vinylformamide, N-vinylacetamide, N-methyl-N-vinylformamide, N-methyl-N-vinylacetamide, N-ethyl-N-vinylformamide, N-ethyl-N-vinylacetamide and N-vinylpropionamide are used as drainage aids, retention agents and flocculants, the polymers being free of aminoalkyl groups and having a K value of not less than 130 (measured according to H. Fikentscher in 5% strength by weight sodium chloride solution at 25° C. and a polymer concentration of 0.1% by weight).

5. A process as claimed in claim 1, wherein homopolymers or copolymers of N-vinylpyrrolidone, N-vinylpiperidone, N-vinylcaprolactam, N-vinyl-3-methylpyrrolidone, N-vinyl-5-methylpyrrolidone, N-vinyl-5-phenylpyrrolidone, N-vinyl-3-benzylpyrrolidone, N-vinyl-4-methylpiperidone, N-vinyl-2-oxazolidone, N-vinyl-5-methyl-2-oxazolidone, N-vinyl-5-ethyl-2-oxazolidone, N-vinyl-5-phenyl-2-oxazolidone, N-vinyl-4-methyl-2-oxazolidone, N-vinyl-3-oxazolid-2-one and N-vinylmorpholinone are used as drainage aids, retention agents and flocculants, the K value of the polymers being not less than 130 (measured according to H. Fikentscher in 5% strength by weight sodium chloride solution at 25° C. and a polymer concentration of 0.1% by weight).

6. A process as claimed in claim 1, wherein the copolymer is of an open-chain or cyclic N-vinylamide is used.

7. A process as claimed in claim 1, wherein the copolymer is of N-vinylformamide and N-vinylpyrrolidone or of N-vinylformamide and N-vinylcaprolactam is used.

8. A process as claimed in claim 1, wherein a resol-type or novolak-type condensate of phenol and formaldehyde is the synthetic phenol resin.

9. A process as claimed in claim 1, wherein compounds of the lignin or humic acid type is the phenol-containing natural oligomers and/or polymers.

10. A process as claimed in claim 1, wherein a wood extract is the phenol-containing natural oligomers and/or polymers.

11. A process as claimed in claim 1, wherein unbleached sulfate pulp, semi-chemical pulp and/or mechanical pulp are the pulp slurry.

12. A process as claimed in claim 2, wherein the polymer is poly-N-vinyl formamide.

13. A process as claimed in claim 12, wherein the poly-N-vinyl formamide has a K value of not less than 130 (measured according to H. Fikentscher in 5% strength by weight sodium chloride solution at 25° C. and a polymer concentration of 0.1% by weight).

14. A process as claimed in claim 13, wherein the poly-N-vinyl formamide has a K value of 175.

15. A process as claimed in claim 13, wherein the poly-N-vinyl formamide has a K value of 190.

16. A process as claimed in claim 13, wherein the poly-N-vinyl formamide has a K value of 227.

* * * * *